US008960821B2

(12) United States Patent
Breisacher

(10) Patent No.: US 8,960,821 B2
(45) Date of Patent: Feb. 24, 2015

(54) PULL-OUT GUIDE FOR DRAWERS

(75) Inventor: Andreas Breisacher, Endingen (DE)

(73) Assignee: Anton Schneider GmbH & Co. KG, Kenzingen (DE)

( * ) Notice: Subject to any disclaimer, the term of this patent is extended or adjusted under 35 U.S.C. 154(b) by 21 days.

(21) Appl. No.: 13/808,822

(22) PCT Filed: Mar. 18, 2011

(86) PCT No.: PCT/EP2011/054118

§ 371 (c)(1),
(2), (4) Date: Jan. 30, 2013

(87) PCT Pub. No.: WO2012/004014

PCT Pub. Date: Jan. 12, 2012

(65) Prior Publication Data

US 2013/0127319 A1 May 23, 2013

(30) Foreign Application Priority Data

Jul. 7, 2010 (DE) ..... 20 2010 007 999 U

(51) Int. Cl.

| | |
|---|---|
| ***A47B 88/00*** | (2006.01) |
| ***A47B 95/00*** | (2006.01) |
| ***A47B 88/04*** | (2006.01) |
| ***A47B 88/10*** | (2006.01) |

(52) U.S. Cl.

CPC ..... *A47B 88/0466* (2013.01); *A47B 88/10* (2013.01); *A47B 2210/007* (2013.01)

USPC ..... 312/331; 312/334.1

(58) Field of Classification Search

CPC ..... A47B 88/10; A47B 88/14; A47B 2210/0075; A47B 2210/007; A47B 2210/0064; A47B 2210/0067; A47B 2210/0072; A47B 2210/0078; A47B 2210/0083

USPC ..... 312/331, 334.23, 334.1

See application file for complete search history.

(56) References Cited

U.S. PATENT DOCUMENTS

| | | | | | |
|---|---|---|---|---|---|
| 1,736,108 | A | * | 11/1929 | Bullen et al. | 312/286 |
| 1,758,550 | A | * | 5/1930 | Wolters | 312/331 |
| 1,902,795 | A | * | 3/1933 | Wolters | 312/331 |
| 3,337,274 | A | * | 8/1967 | Green | 384/17 |

(Continued)

FOREIGN PATENT DOCUMENTS

| | | |
|---|---|---|
| AT | 360699 | 1/1981 |
| CN | 101623150 | 1/2010 |

(Continued)

*Primary Examiner* — Daniel J Troy
*Assistant Examiner* — Timothy M Ayres
(74) *Attorney, Agent, or Firm* — Lucas & Mercanti, LLP; Klaus P. Stoffel

(57) ABSTRACT

A pull-out guide for drawers, including a body rail, a drawer rail, and a center rail which runs differentially between these two and is guided in two rolling body carriages. The center rail has a toothed wheel and the two rolling body carriages each have one toothed rack that meshes with the toothed wheel. When the pull-out guide is completely pulled out, the drawer rail is pulled out beyond the body rail. Each toothed rack includes a toothed rack end section which projects past the rolling body carriage and meshes with the toothed wheel when the pull-out guide is completely pulled out. The body rail and/or the drawer rail each have a support on which a side of the toothed rack end section facing away from the tooth profile is supported when the pull-out guide is completely pulled out.

5 Claims, 3 Drawing Sheets

(56) References Cited

U.S. PATENT DOCUMENTS

| | | | | | |
|---|---|---|---|---|---|
| 3,857,618 | A | * | 12/1974 | Hagen et al. | 384/18 |
| 4,351,575 | A | * | 9/1982 | Rock et al. | 384/18 |
| 4,445,726 | A | * | 5/1984 | Rock et al. | 384/19 |
| 4,470,642 | A | * | 9/1984 | Gasperin | 384/19 |

FOREIGN PATENT DOCUMENTS

| | | | |
|---|---|---|---|
| DE | 102004002823 | A | 8/2005 |
| EP | 1516563 | | 3/2005 |
| WO | 0111261 | Y | 2/2001 |

* cited by examiner

PULL-OUT GUIDE FOR DRAWERS

The present application is a 371 of International application PCT/EP2011/054118, filed Mar. 18, 2011, which claims priority of DE 20 2010 007 999.3, filed Jul. 7, 2010, the priority of these applications is hereby claimed and these applications are incorporated herein by reference.

BACKGROUND OF THE INVENTION

The invention relates to a pull-out guide for drawers or the like, comprising a body rail, a drawer rail, and a center rail which runs differentially between these two and is guided in two rolling body carriages, one of which is supported in the body rail and the other is supported in the drawer rail, wherein the center rail comprises a toothed wheel and the two rolling body carriages each comprise one toothed rack that meshes with the toothed wheel and wherein, when the pull-out guide is completely pulled out, the drawer rail is pulled out beyond the body rail.

The given installation depth of a piece of furniture is just sufficient for full extension of the drawer when the guide lengths are utilized in a standard way. A required increase in length of extension of the drawer without increasing the installation depth is realized in practice by an over-extension, whereby the drawer rail is pulled out beyond the body rail. The problems of overcoming the movement of drawer rail and body rail away from each other and maintaining the differential or synchronization of these two rails represent the main difficulty in addition to the decreasing stability, since the remaining section is only overcome by the center rail.

In accordance with prior art, over-extensions of drawer rails and body rails that move away from each other and maintenance of synchronization are realized in a complex manner via strings, foldable support elements, foldable toothed racks and the like. Takeover of synchronization in the over-extended section is conventionally also realized by a plurality of toothed wheels.

SUMMARY OF THE INVENTION

In contrast thereto, it is the object of the present invention to obtain a pull-out guide with over-extension of the above-mentioned type using a minimum number of elements and also to eliminate any malfunction.

This object is achieved in accordance with the invention in that each toothed rack comprises a toothed rack end section which projects past the rolling body carriage and meshes with the toothed wheel when the pull-out guide is completely pulled out, and the body rail and/or the drawer rail each have a support, on which a side of the toothed rack end section facing away from the tooth profile is supported at least when the pull-out guide is completely pulled out.

This inventive support prevents the toothed racks in the over-extended area from moving away from each other due to the load and deformation of the guiding elements and prevents disengagement of the toothed wheel, which would disturb synchronization.

The support is advantageously formed by a projection of the body rail or the drawer rail, in particular, by a lug or an embossing. The support can alternatively also be formed by an additional element.

The toothed rack end section advantageously has an inclined surface on a side facing away from the tooth profile, with which inclined surface the toothed rack end section runs onto the support when the pull-out guide is pulled out.

In one particularly preferred embodiment which, in accordance with the invention, can also be formed without the support of the toothed rack end sections, the toothed wheel comprises on its side facing away from the center rail a flank which radially projects to the outside past the toothed rim and prevents lateral breaking away of the toothed racks, in particular of the toothed rack end sections.

Further advantages of the invention can be extracted from the description and the drawing. The features mentioned above and below can be used in accordance with the invention either individually or collectively in arbitrary combination. The illustrated and described embodiments are not to be understood as exhaustive enumeration but have exemplary character for describing the invention.

The invention is shown in the drawing and is explained in more detail with reference to embodiments. In the drawings:

DETAILED DESCRIPTION OF THE INVENTION

Figure 1:
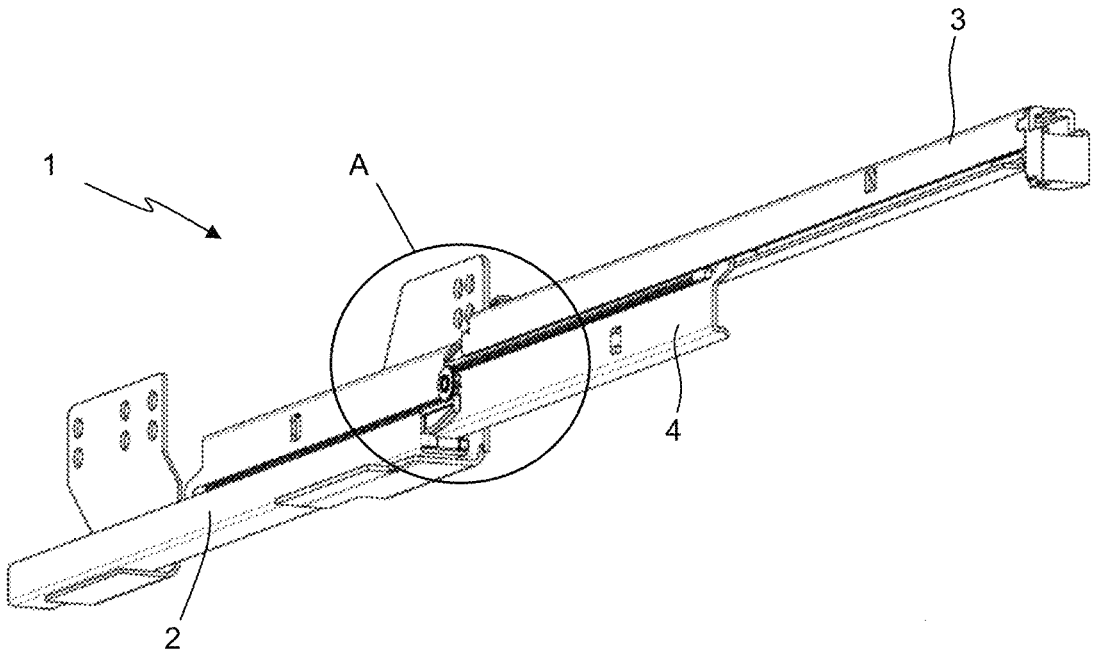
FIG. 1 shows a perspective view of the inventive pull-out guide for a drawer.

The pull-out guide 1 for a drawer, illustrated in FIG. 1, comprises a body rail 2, a drawer rail 3 and a center rail 4 which runs differentially between these two.

Figure 2A:
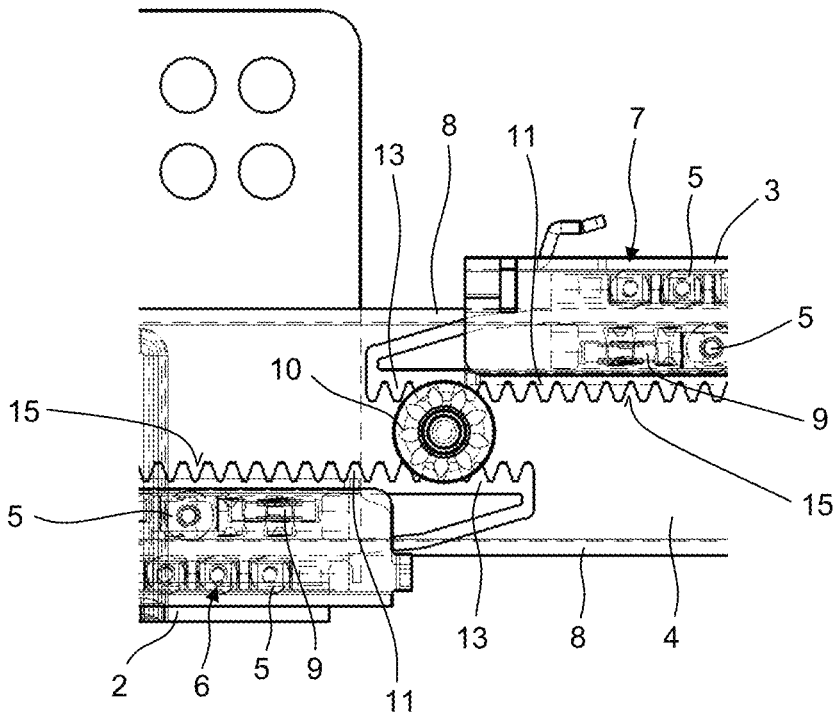
FIGS. 2*a*, 2*b* show a side view of the inventive pull-out guide in the area of a toothed wheel, illustrated in FIG. 1, shortly before its completely over-extended end position (FIG. 2*a*) and in the completely over-extended end position (FIG. 2*b*)

As is illustrated in FIG. 2*a*, the rails 2, 3, 4 are guided via rolling bodies 5 in such a manner that they can be displaced relative to each other in a longitudinal direction. The rolling bodies 5 are rotatably supported inside rolling body cages of two rolling body carriages 6, 7, of which the lower rolling body carriage 6 is supported in the body rail 2 and the upper rolling body carriage 7 is supported in the drawer rail 3. The horizontal webs 8 of the center rail 4 are inserted into the rolling body carriages 6 or 7 and are each supported between the upper and lower rolling bodies 5 of the rolling body carriages 6, 7. The rolling body carriages 6, 7 also comprise horizontal compensating rollers 9 which laterally roll on the vertical webs of the rails, namely with respect to the lower rolling body carriage 6 on the body rail 2 and the center rail 4 and with respect to the upper rolling body carriage 7 on the drawer rail 3 and the center rail 4. The center rail 4 has a toothed wheel 10 and the two rolling body carriages 6, 7 each have a toothed rack 11 that meshes with the toothed wheel 9 for synchronizing the operation of the body rail and the drawer rail 2, 3.

Figure 2B:
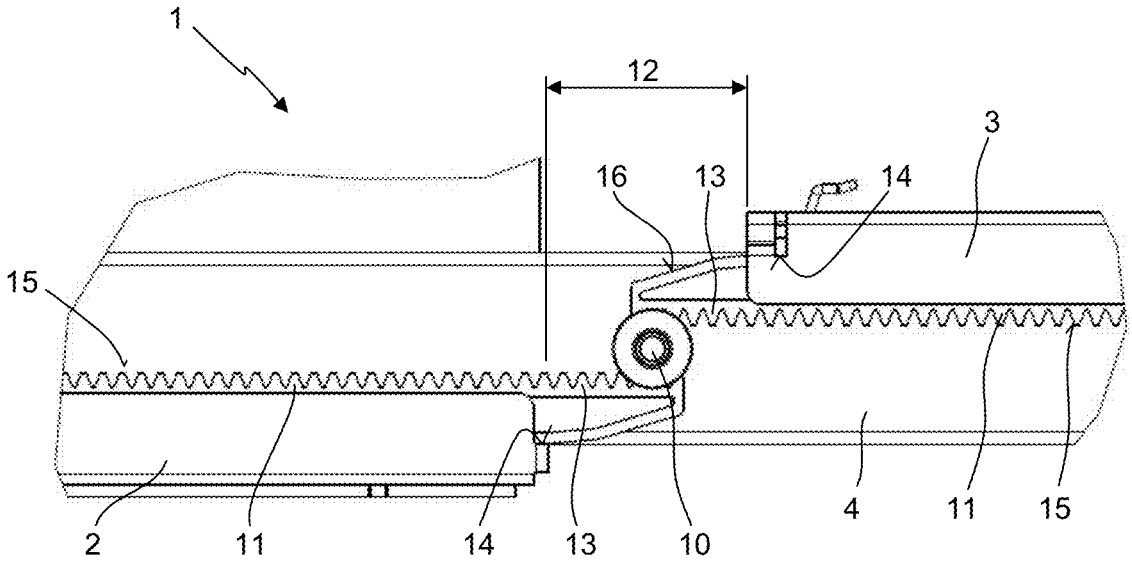

FIG. 2*b* shows the pull-out guide 1 in its completely over-extended end position in which the drawer rail 3 is pulled out beyond the body rail 2 by the length of the over-extension 12, whereas FIG. 2*a* shows the pull-out guide 1 in an over-extended position just before this end position. The toothed racks 11 each have a toothed rack end section 13 which projects past the rolling body carriage 6, 7 and meshes with the toothed wheel 10 when the drawer rail 3 is over-extended. The body rail 2 and the drawer rail 3 each have a support 14 on which the rear sides of the toothed rack end sections 13 facing away from the tooth profile 15 are supported when the drawer rail 3 is over-extended. Just before reaching the over-extended end position, an inclined surface 16 of the toothed rack end section 13 runs onto the support 14 until the toothed rack end section 13 is supported on the support 14 in the over-extended end position. This support prevents the toothed racks 11 in the over-extended area 12 from moving away from each other due to the load and deformation of the guiding elements and prevents disengagement of the toothed wheel 10, which would disturb synchronization.

Figure 3:
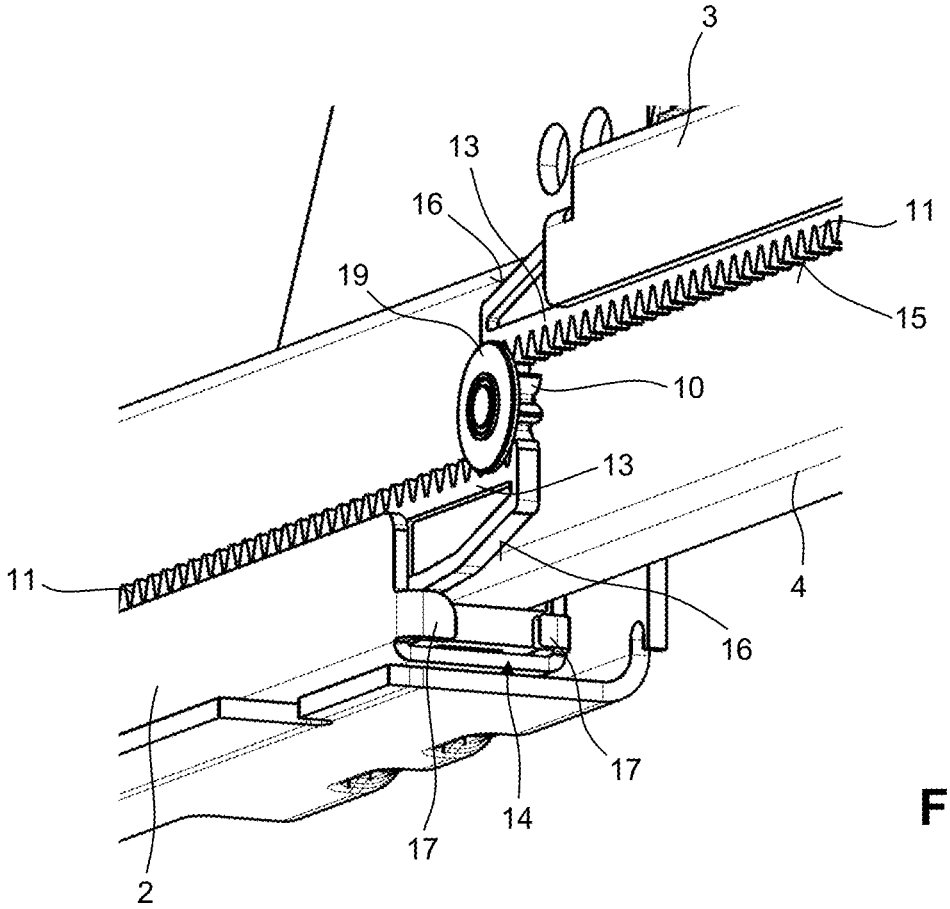
FIG. 3 shows a detailed view of the inventive pull-out guide in accordance with detail A of FIG. 1.

As is illustrated in FIG. 3, the support 14 can be formed by two lugs 17 of the body rail and drawer rail 2, 3, which are bent to the inside and on which the toothed rack end sections 13 are supported when the drawer rail 3 is over-extended.

Figure 4:
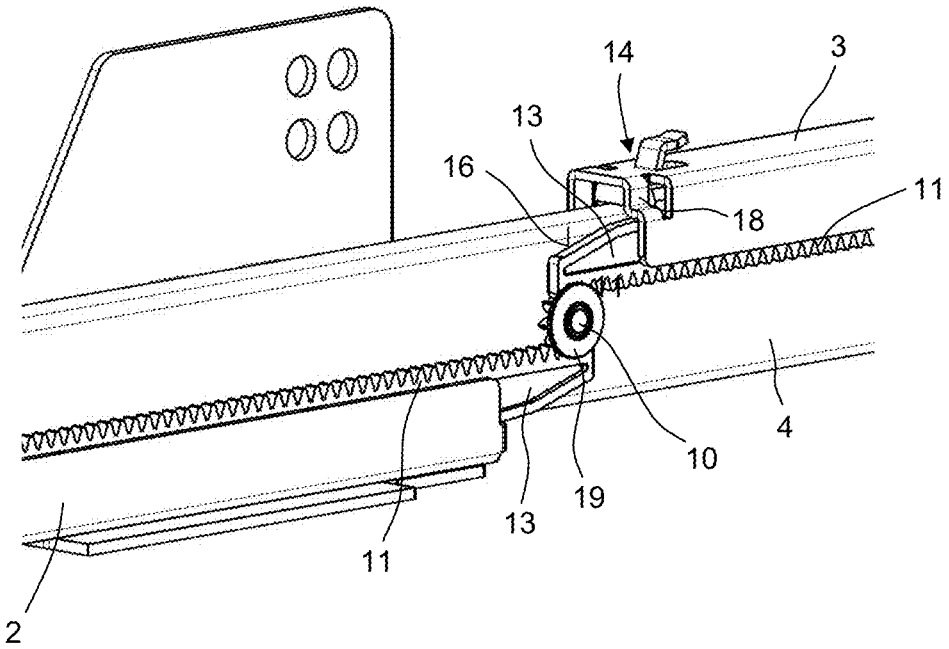
FIG. 4 shows a detailed view of a modification of the inventive pull-out guide.

In contrast thereto, the support 14 of FIG. 4 is formed by embossings 18 which are embossed into the body rail and drawer rail 2, 3 and on which the toothed rack end sections 13 are supported when the drawer rail 3 is over-extended.

In an alternative fashion, the support 14 can also be formed by a separate element which is fixed to the body rail or drawer rail 2, 3.

As is further illustrated in FIGS. 3 and 4, the toothed wheel 10 has a flank 19 on its side facing away from the center rail 4, which flank 19 radially projects to the outside past the toothed rim and prevents lateral breaking away of the toothed racks 11 and, in particular of the toothed rack end sections 13.

The invention claimed is:

1. A pull-out guide for drawers, comprising; a body rail; a drawer rail; a center rail that that runs differentially between the body rail and the drawer rail; and two rolling body carriages, one of the rolling body carriages being supported in the body rail and another of the rolling body carriages being supported in the drawer rail, the center rail being guided in the two rolling body carriages, wherein the center rail comprises a toothed wheel and the two rolling body carriages each comprise one toothed rack that meshes with the toothed wheel and wherein, when the pull-out guide is completely pulled out, the drawer rail is pulled out beyond the body rail, wherein the toothed rack of each rolling body carriage comprises a toothed rack end section that projects past the rolling body carriage and meshes with the toothed wheel when the pull-out guide is completely pulled out, and the body rail and/or the drawer rail each have a support on which a side of the toothed rack end section facing away from a tooth profile of the toothed rack is supported at least when the pull-out guide is completely pulled out, wherein the support is formed by a lug or an embossing, wherein the toothed rack end section has an inclined surface on the side facing away from the tooth profile arranged so that the inclined surface of the toothed rack end section wedges above the support when the pull-out guide is pulled out.

2. The pull-out guide according to claim 1, wherein the support is formed by a projection of the body rail or the drawer rail.

3. The pull-out guide according to claim 1, wherein the support is formed by an additional element.

4. The pull-out guide according to claim 1, wherein the toothed wheel has a flank on a side facing away from the center rail, so that the flank radially projects to an outside past a toothed rim of the toothed wheel and prevents lateral breaking away of the toothed racks.

5. The pull-out guide according to claim 4, wherein the flank prevents lateral breaking away of the toothed rack end sections.

* * * * *